US009194220B2

(12) United States Patent
Gill et al.

(10) Patent No.: US 9,194,220 B2
(45) Date of Patent: Nov. 24, 2015

(54) APPARATUS AND METHOD FOR DETERMINING FLUID INTERFACE PROXIMATE AN ELECTRICAL SUBMERSIBLE PUMP AND OPERATING THE SAME IN RESPONSE THERETO

(71) Applicants: Cooper C. Gill, Houston, TX (US); Luke Wingstrom, Houston, TX (US); XiaoWei Wang, Houston, TX (US)

(72) Inventors: Cooper C. Gill, Houston, TX (US); Luke Wingstrom, Houston, TX (US); XiaoWei Wang, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 287 days.

(21) Appl. No.: 13/838,177

(22) Filed: Mar. 15, 2013

(65) Prior Publication Data

US 2014/0262244 A1 Sep. 18, 2014

(51) Int. Cl.

| | |
|---|---|
| ***E21B 47/047*** | (2012.01) |
| ***E21B 47/07*** | (2012.01) |
| ***E21B 43/12*** | (2006.01) |
| ***E21B 47/04*** | (2012.01) |
| ***E21B 47/06*** | (2012.01) |
| *E21B 47/12* | (2012.01) |

(52) U.S. Cl.

CPC ..... *E21B 43/128* (2013.01); *E21B 47/042* (2013.01); *E21B 47/065* (2013.01); *E21B 47/123* (2013.01)

(58) Field of Classification Search

CPC ... E21B 43/128; E21B 47/042; E21B 47/065; E21B 47/04; E21B 47/0007

See application file for complete search history.

(56) References Cited

U.S. PATENT DOCUMENTS

| | | | | |
|---|---|---|---|---|
| 4,273,650 | A * | 6/1981 | Solomon | 210/104 |
| 7,546,870 | B1 | 6/2009 | Dotson | |
| 2002/0166663 | A1 | 11/2002 | Last et al. | |
| 2003/0159828 | A1* | 8/2003 | Howard et al. | 166/372 |
| 2005/0217350 | A1 | 10/2005 | Jabusch et al. | |
| 2006/0233217 | A1 | 10/2006 | Gleitman | |
| 2007/0051514 | A1 | 3/2007 | La Rovere | |
| 2007/0158064 | A1* | 7/2007 | Pribnow et al. | 166/250.01 |
| 2008/0314142 | A1* | 12/2008 | Davies | 73/295 |
| 2010/0038078 | A1* | 2/2010 | Fink | 166/250.15 |

OTHER PUBLICATIONS

PCT International Search Report and Written Opinion; International Application No. PCT/US2014/016772; International Filing Date: Feb. 18, 2014; Date of Mailing: May 20, 2014; pp. 1-15.

* cited by examiner

*Primary Examiner* — Robert E Fuller
(74) *Attorney, Agent, or Firm* — Cantor Colburn LLP

(57) ABSTRACT

A production system placed inside a wellbore has a production tubing and an ESP for flowing fluid from the wellbore into the production tubing. A sensor string including distributed sensors is placed along the sensor string and provides temperature measurements along the production tubing uphole of the ESP. A controller determines from the temperature measurements a change in temperature that exceeds a threshold and determines therefrom level of a liquid in the wellbore.

17 Claims, 2 Drawing Sheets

APPARATUS AND METHOD FOR DETERMINING FLUID INTERFACE PROXIMATE AN ELECTRICAL SUBMERSIBLE PUMP AND OPERATING THE SAME IN RESPONSE THERETO

BACKGROUND

1. Field of the Disclosure

This disclosure relates generally to production of hydrocarbons from wells using electrical submersible pumps.

2. Brief Description of the Related Art

Oil wells (wellbores) are drilled to a selected depth in earth formations for the production of hydrocarbons. Such wells are often cased after drilling with a metallic casing. A production string containing a variety of devices is placed inside the casing to flow fluid from the formations to the surface. Formation fluid often includes oil, gas and water. Oil is separated from water and gas at the surface and transported for processing. The production string includes a variety of device, such as zone isolation devices, such as packers, sand control devices for controlling flow of solid particles from the formation into the production tubing, and flow control device, such as valves that control the flow of the formation fluid into the wellbore, The fluid in the tubing flows to a surface separator, where oil is separated from gas and water. The formation fluid typically flows naturally into the production tubing because the pressure of the formation is greater than the pressure in the tubing. In the early phases of oil wells, the differential pressure between the formation and the production tubing is sufficient to cause the fluid in the tubing to reach the surface. In the later phases of some wells, this pressure differential is not sufficient to cause the fluid in the tubing to flow to the surface. In some such cases an artificial lift mechanism in the wellbore is used to pump the fluid in the production tubing to the surface. A common lifting mechanism used is an electrical submersible pump ("ESP"). An ESP is installed in the wellbore to draw or lift the liquid fluid from the wellbore into the production tubing. The ESP is designed to remain submerged in a liquid during operation. A selected level of the liquid (oil and/or water) above the ESP is desired for optimal ESP use.

The disclosure herein provides a system for controlling the liquid level (or "head") above the ESP in real or substantially real time and for controlling the operation of the ESP.

SUMMARY

In one aspect, a production system is disclosed that in one embodiment may include a production tubing placed inside a wellbore, an ESP in the wellbore for flowing fluid from the wellbore into the production tubing, a sensor string including distributed sensors that provides temperature measurements along the production tubing uphole of the ESP, and a controller that determines from the temperature measurements a change in temperature that exceeds a threshold and determines therefrom level of a liquid in the wellbore above.

In another aspect, a method of producing fluid from a well is disclosed that in one embodiment may include: providing an ESP in the wellbore for pumping fluid into a production tubing; measuring temperature at a plurality of locations along at least a section of the production tubing uphole of the ESP; and determining from the measured temperatures at the plurality of locations a level of a liquid in the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings, wherein.

DESCRIPTION OF THE DRAWINGS

Figure 1:
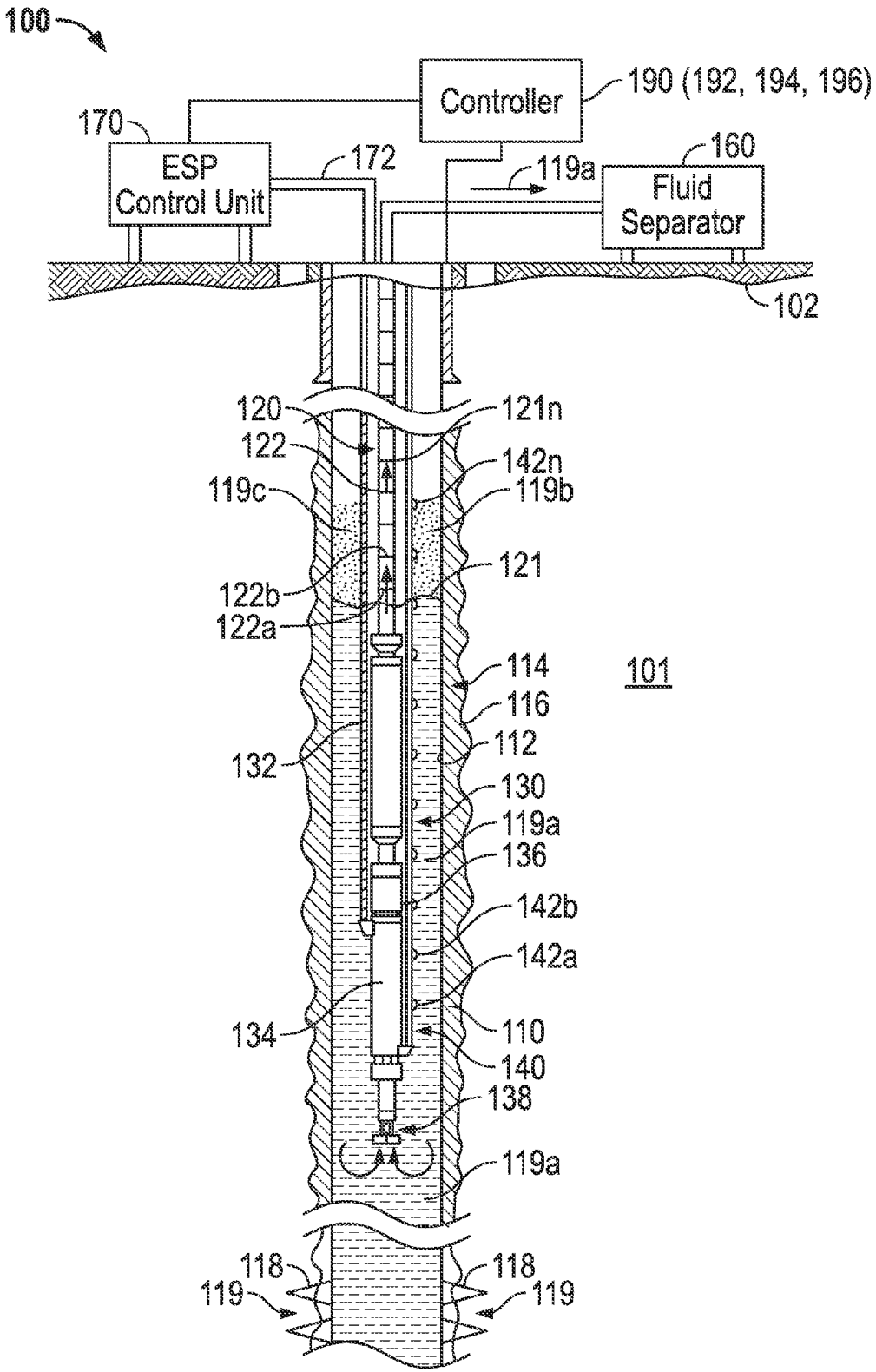
FIG. 1 is a schematic diagram of an exemplary well system that includes an ESP in a production string and a string of distributed sensors for controlling the liquid head over the ESP and for controlling the operation of the ESP, according to one embodiment of the disclosure.

FIG. 1 is a schematic diagram of an exemplary wellbore or well system 100 that uses an ESP to produce fluids from the wellbore, according to one embodiment of the disclosure. The wellbore system 100 includes a well 110 formed in a formation 101 from a surface location 102. A casing 112 is placed inside the well 110 and the space 114 between the well 110 and the casing 112 is filled with cement 116. A production string 120 is deployed inside the casing 112 to flow the fluids from the wellbore to the surface 102. The casing 112 has perforations 118 that allow the formation fluid 119 from the formation 102 to flow into the well 110. Various flow control devices (not shown) are placed in the well proximate the perforations to control the flow of the formation fluid 119 into the well 110. The formation fluid typically includes oil, water and gas. In the system 100, liquid 119*a* in the formation fluid entering the well 110 is shown filling the well 110 up to a level 121, while the gas 119*b* fills the well 110 above the liquid level 121. In the early phases of a wellbore life, the pressure of the formation proximate the perforations 118 is sufficiently high to cause the fluid 119*a* to flow to the surface 102. In some wells, the pressure at some stage in the well's life is not sufficient to cause the formation fluid in the well to flow to the surface. In such cases, an artificial lift mechanism is installed in the well to move the formation fluid to the surface. In the system 100, the production string 120 includes a tubing 122 and an electrical submersible pump (ESP) 130 to move the liquid 119*a* in the well 110 into the tubing 122 and to the surface 102. The ESP 130 includes a motor 132 that drives a pump 134 and seals 136. In operation, the pump causes the liquid 119*a* in the well 110 to enter into an inlet 138 and then to the surface 102 via the tubing 122.

The fluid from the tubing 122 flows into a surface unit 160 configured to separate oil from water and any gas. An ESP control unit 170 provides power to the ESP 130 via a control line 172 to operate the ESP 130 at a desired speed. A controller 190 at the surface controls the ESP 130 according to programmed instructions and/or by input from an operator. In one aspect, the controller 190 is a computer-based system that includes a processor 192, such as microprocessor, a data storage device 194, such as a solid state memory, and programs 196 accessible to the processor 192 for executing instructions contained in such programs.

The well system 100 further includes a distributed sensor string or link, such as a fiber optic link 140 that includes a number of spaced apart (distributed) sensors 142*a* through 142*n* along the ESP 130 and at least a section of the tubing 122 uphole of the ESP 130. The sensors 142*a* through 142*n* may be spaced as desired to provide temperature measurement along the length of the fiber optic link 140. In one aspect, the fiber optic link 140 is clamped to the ESP and the tubing at spaced apart locations, such as at pipe joints 122*a*, 122*b* . . . 122*n*. The pipe joints are typically about 10 meters apart and 2-5 temperature sensors may be placed in each meter of the fiber optic link 140. In another aspect, the fiber optic link 140 may also contain other sensors, such as pressure sensors. Although, the temperature sensors shown are on a fiber optic link, any other temperature sensors may be placed along the tubing for the purpose of this disclosure.

In the system 100, the temperature sensors 142*a*, 142*b* . . . 142*n* measurements are transmitted to the controller 190 continuously or at discrete time intervals, such as every minute or five minutes. In one aspect, the controller 190 determines when the change in temperature form one sensor to the next exceeds a threshold and determines therefrom the location of the level 121 of the liquid 119*a* in the well. In one aspect, if the level 121 is outside a desired level or range, the controller 190 alters an operation of the ESP 130 to maintain or substantially maintain the level 121 at a desired level above the ESP 130. ESP's are designed to remain submerged in the liquid during operation. A certain liquid level above the ESP enables the ESP to operate optimally. The controller 190, in one aspect, controls the speed of the pump 132, via the ESP control unit 170 to maintain or substantially maintain the liquid 119*a* at a level that provides optimal ESP operation. In some cases, when the liquid level falls below a certain level, the controller 190 may send an alarm to an operator and/or shut off the pump. Thus, the system 100 provides a real time determination of the level of the liquid surrounding an ESP and provides a real time control of such ESP in response to such liquid level based on one or more selected criteria.

Still referring to FIG. 1, the fiber optic link 140 is typically clamped at spaced apart locations 122*a*, 122*b* . . . 122*n*, etc. on the tubing 122. At such clamped locations, the fiber optic link 140 and thus any sensors, such as sensors 142*a*, 142*b*, etc. are in contact with the production tubing. The temperature of the fluid 129*a* (oil and water) flowing through the ESP 130 and the tubing 120 is greater than the temperature of the liquid in the annulus above the ESP 140. The temperature of the gas 119*b* above the liquid line 121 is often substantially lower than the temperature of the liquid 119*a* in the tubing 122. The fiber optic link 140 between the clamps is somewhat loose in the annulus between the production tubing 122 and casing 112. Therefore the sensors at the clamped location will exhibit higher temperature than the sensors at in between locations. Also a sudden temperature drop at the transition level 121 between the liquid and gas will be present. A method of determining the liquid level using temperature profile along the ESP and tubing is described below in reference to FIG. 2.

Figure 2:
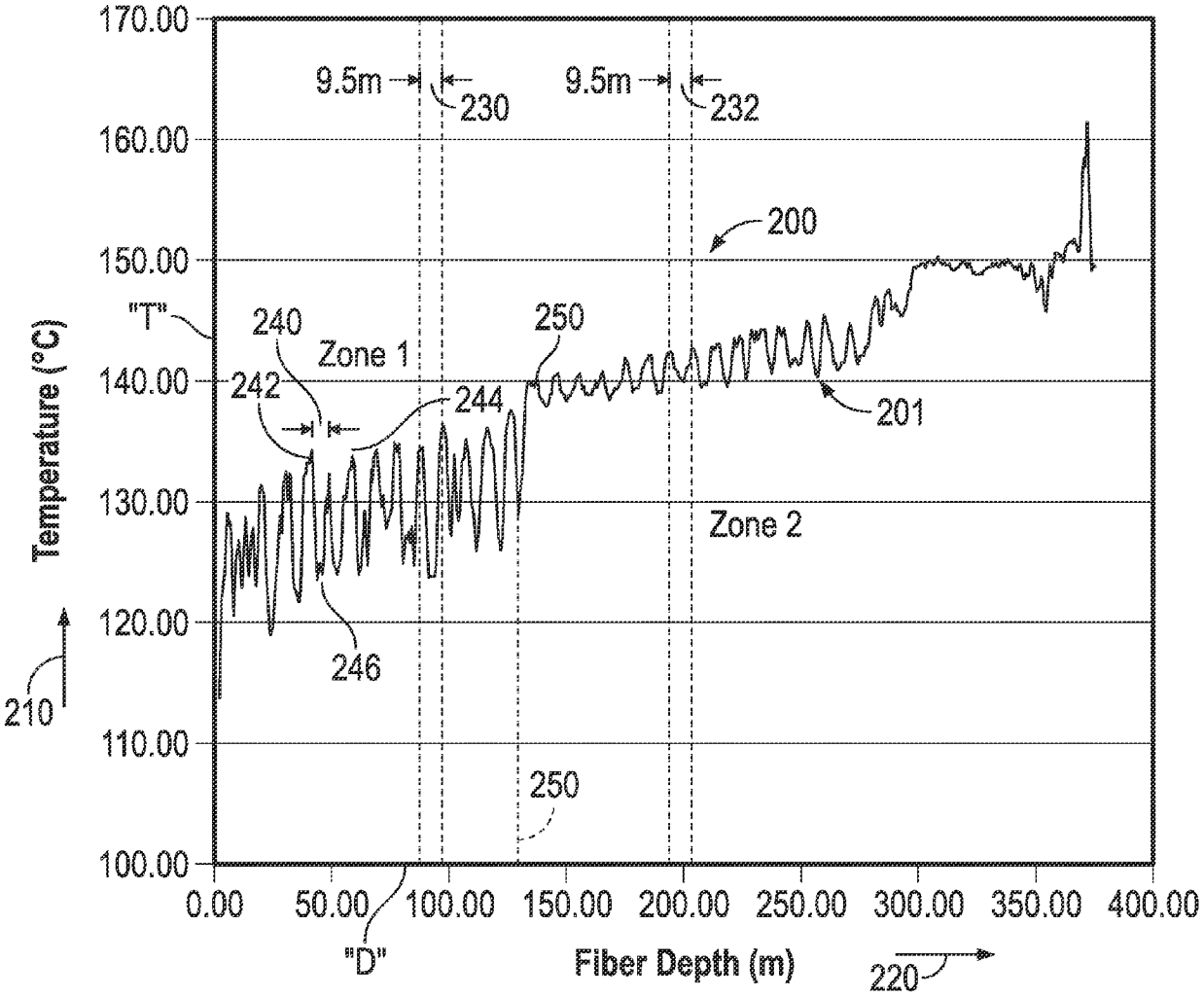
FIG. 2 is an exemplary temperature profile of a production well of the type shown in FIG. 1 that may be used to determine the phase separation of fluids in the well proximate the ESP.

FIG. 2 is an exemplary temperature profile 200 of temperature measurements taken at a particular or selected time over a selected well depth, ranging from an ESP to a selected location uphole of the ESP. The temperature "T" is shown along the vertical axis 210 and the well depth "D" is shown along the horizontal axis 220. The temperature profile 200 corresponds to a single trace 201, i.e., temperatures taken at various depths "D" at or substantially the same time, for example time "$t_1$". The trace 201 corresponds to temperature measurements wherein the fiber optic link containing temperature sensors was clamped to the production pipe every approximately 9.5 meters as indicated by gaps 230 and 232. The clamps were placed both in the liquid section and gas section of the production tubing. The trace 201 shows highest temperature readings at the clamped locations and declining temperature between the clamps. For example, the temperatures at adjoining clamped locations 242 and 244 are higher than the temperature at the middle point 246 between the clamp locations 242 and 244. The temperatures in the gap 240 declines from the high temperature at clamp location 242 to the middle point 246 and then rises toward the high temperature of clamp location 244. Thus, as shown by trace, 201, when the fiber cable is away from the clamps, the fiber cable is loose and the small gaps between the production tubing and the fiber cable disrupt heat transfer from the production tubing to the fiber cable. Conductive heat transfer is no longer dominant as the fluids in the annulus surround the fiber cable. Therefore, the measured temperature at locations between the clamps is representative of the annulus fluid temperature.

In one aspect, the distributed temperature measurements, such as represented by trace 201, are used to identify and track in real time the fluid level in the annulus above the ESP. In one aspect, this may be accomplished by determining a step temperature change in the trace 201, which is indicative of the interface between the liquid and gas in the annulus. Trace 201 shows two zones, zone 1 and zone 2, along the wellbore depth "D." In zone1, the temperature profile 200 shows temperature peaks and valleys between clamp locations. For example, between clamps in section 240, the first peak 242 is at the first clamp location, the second peak 244 is at the next clamp location 244 and the valley is proximate the middle of the two clamps at location 246. In the particular example of trace 201 shown in FIG. 2, the change in temperature from the peak value to the valley value is about 9° C. Similarly, the temperature drop between the clamps at gap 232 is about 2.6° C. There also is a step temperature change from zone1 to zone 2 at well depth 250. The zone 2 corresponds to where there is oil in the annulus and zone 1 corresponds to where there is gas in the annulus. The step change from zone 1 to zone 2 corresponds to the interface between the gas and liquid in the annulus. The temperature drop between clamps where there is liquid in the annulus, such as the about 2.6° C. drop, is less than the temperature drop between clamps where there is gas in the annulus, such as the 9° C. drop. In general, the temperature of the liquid in the annulus is relatively close to the temperature of the liquid in the production tubing. Therefore, the difference in the temperature between adjacent peaks (temperature at the clamps on the production tubing carrying the liquid) and the temperature at their corresponding valley (temperature of the liquid in the annulus away from the clamps) is relatively small. Also, the temperature of the gas in the annulus is typically less than the temperature of the liquid in the annulus. Therefore, where there is gas in the annulus, the temperature drop between the temperature at adjacent peaks and the temperature at their corresponding valley is relatively large. In the trace 201, the gas-liquid interface occurs at depth 250 corresponding to the step change shown in temperature profile 200.

Referring now to FIGS. 1 and 2, in practice, the controller 190 periodically, such as every one minute or five minutes, etc., analyzes the temperature profile, such as profile 200, and determines a change in temperature that exceeds a threshold, such as a change from zone 1 to zone 2, and correlates such change to the wellbore depth, such as depth 250, which is indicative of the liquid level 121. In one aspect, if the determined liquid level is below a desired or predetermined level, the controller 190 adjusts the ESP decreases the ESP output to raise the liquid level and if the liquid level is above the desired level, the controller increases the ESP output to lower the liquid level. In another aspect, the controller may send an alarm based on the determined liquid level and/or may shut off the ESP.

The foregoing description is directed to certain embodiments for the purpose of illustration and explanation. It will be apparent, however, to persons skilled in the art that many modifications and changes to the embodiments set forth above may be made without departing from the scope and spirit of the concepts and embodiments disclosed herein. It us is intended that the following claims be interpreted to embrace all such modifications and changes.

The invention claimed is:

1. A system for controlling flow of a formation fluid from a wellbore, wherein the wellbore includes a production tubing placed inside the wellbore and wherein space between the wellbore and the production tubing defines an annulus and wherein the annulus includes liquid and gas, the system comprising:

an ESP in the wellbore for flowing the formation fluid from the wellbore into the production tubing;

a sensor string clamped to the ESP and the production tubing at spaced apart locations, the sensor string including distributed sensors that provide temperature measurements along the ESP and the production tubing at least periodically; and a controller that determines from the temperature measurements a change in temperature between sensors that exceeds a temperature threshold and determines therefrom a level of the liquid in the annulus.

2. The system of claim 1, wherein the sensor string is a fiber optic string and the sensors are temperature sensors.

3. The system of claim 1, wherein the controller determines at least one temperature profile corresponding to wellbore depth and determines therefrom when the change in temperature exceeds the threshold.

4. The system of claim 3, wherein the controller periodically computes temperature profiles and determines the liquid level in the annulus.

5. The system of claim 1, wherein the controller further determines when the level of the liquid in the annulus is below a selected depth and controls an operation of the ESP in response thereto.

6. The system of claim 5, wherein control of the ESP includes at least one of: reducing speed of the ESP; increasing speed of the ESP; shutting off the ESP; and starting the ESP.

7. The system of claim 1, wherein the controller maintains the level of the liquid in the annulus above the ESP.

8. The system of claim 1, wherein the controller determines a gas-liquid interface from the change in the temperature.

9. A method of producing fluid from a wellbore, comprising providing an ESP in the wellbore for pumping fluid into a production tubing;

measuring temperature at a plurality of locations along a section of the production tubing along and uphole of the ESP using a sensor string clamped to the production tubing at spaced apart locations along and uphole of the ESP, the sensor string including distributed sensors; and determining from the measured temperatures at the plurality of locations a change in temperature between sensors that exceeds a temperature threshold to determine a level of liquid in the wellbore; and adjusting the ESP to control the level of the liquid in the wellbore while pumping fluid from the wellbore.

10. The method of claim 9, wherein measuring temperature comprises using a fiber optic string containing distributed temperature sensors.

11. The method of claim 9 further comprising using a controller to determine at least one temperature profile corresponding to wellbore depth and determine therefrom when a change in temperature along the section of the production tubing exceeds the temperature threshold.

12. The method of claim 11, wherein the controller periodically computes temperature profiles and determines the liquid level in the wellbore in real time.

13. The method of claim 12, wherein the controller further determines when the level of the liquid in the wellbore is below a selected depth and controls an operation of the ESP in response thereto.

14. The method of claim 13, wherein control of operation of the ESP includes at least one of: reducing speed of the ESP; increasing speed of the ESP; shutting off the ESP; and starting the ESP.

15. The method of claim 11, wherein the controller maintains the level of the liquid in the wellbore above the ESP.

16. The method of claim 11, wherein the controller determines a gas-liquid interface from the change in the temperature.

17. The method of claim 16, wherein the controller further determines a wellbore depth of the gas-liquid interface.

* * * * *